United States Patent [19]

Loricchio et al.

[11] 4,237,152

[45] Dec. 2, 1980

[54] PROCESS FOR IMPROVING THE RESISTANCE OF ASPHALT PAVEMENT SURFACES TO CORROSION, DETERIORATION AND DISINTEGRATION

[76] Inventors: Domingos Loricchio; Orlando M. Lomonaco; Luiz M. Lomonaco, all of Brazil

[21] Appl. No.: 784,606

[22] Filed: Apr. 4, 1977

Related U.S. Application Data

[63] Continuation of Ser. No. 552,048, Feb. 24, 1975, abandoned, which is a continuation-in-part of Ser. No. 418,774, Nov. 23, 1973, abandoned.

[30] Foreign Application Priority Data

Nov. 29, 1972 [BR] Brazil ..... 8378

[51] Int. Cl.[2] ..... B05C 1/16; B05D 5/10; E01C 5/00

[52] U.S. Cl. ..... 427/136; 106/14.33; 106/14.44; 260/19 EP; 260/22 CB; 260/28.5 HS; 260/31.2 N; 260/31.2 T; 260/31.2 XA; 260/33.6 EP; 260/33.6 UA; 260/33.6 UB; 260/33.8 EP; 260/33.8 UA; 260/33.8 UB; 427/314; 428/329; 428/331; 525/109; 525/134; 525/166; 525/136

[58] Field of Search ..... 427/136, 139, 314, 359, 427/138; 106/288 B, 14, 14.05, 14.33, 14.44; 260/33.6 R33.6 UA, 33.6 UB, 33.6 EP, 285 AS, 19 EP, 22 CB, 33.8 EP, 33.8 UA, 33.8 UB, 31.2 T, 31.2 XA, 31.2 R; 404/72, 20, 75, 21, 77, 79; 428/329, 323, 331; 525/109, 134, 166, 456

[56] References Cited

U.S. PATENT DOCUMENTS

| | | | |
|---|---|---|---|
| 850,382 | 4/1907 | Lutz | 427/314 |
| 2,574,971 | 11/1951 | Heltzer | 260/40 |
| 2,706,936 | 4/1955 | Wilson | 404/21 |
| 2,906,720 | 9/1959 | Simpson | 427/136 |
| 2,925,831 | 2/1960 | Welty et al. | 404/20 |
| 2,948,201 | 8/1960 | Nagin et al. | 427/136 |
| 3,008,387 | 11/1961 | Wittenwyler et al. | 427/136 |
| 3,271,109 | 9/1966 | Mezey et al. | 423/345 |
| 3,272,098 | 9/1966 | Buchholtz et al. | 427/136 |
| 3,291,011 | 12/1966 | Defregger et al. | 427/139 |
| 3,516,847 | 6/1970 | Schuster et al. | 427/314 |
| 3,679,612 | 7/1972 | Titow | 260/33.6 |
| 3,679,626 | 7/1972 | Trackusa et al. | 260/28.5 |
| 3,690,227 | 9/1972 | Welty | 404/20 |

FOREIGN PATENT DOCUMENTS

| | | | |
|---|---|---|---|
| 1247171 | 9/1971 | United Kingdom | 404/20 |

*Primary Examiner*—Ronald H. Smith
*Assistant Examiner*—S. L. Childs
*Attorney, Agent, or Firm*—Michael J. Striker

[57] ABSTRACT

Processes for the treatment of asphalt pavements such as asphalt roads and sidewalks to make them more resistant to corrosion, that is, resistant to deterioration and disintegration, which comprises applying to the asphalt pavement a liquid composition consisting essentially of finely divided particles of a solid substance having a hardness between 8.5 and 9.5 on the Moh scale, such as a mixture of particles of silicon carbide and electrofused alumina, dispersed in a vehicle consisting of one or more organic synthetic resins and one or more solvents for the resin.

12 Claims, No Drawings

PROCESS FOR IMPROVING THE RESISTANCE OF ASPHALT PAVEMENT SURFACES TO CORROSION, DETERIORATION AND DISINTEGRATION

REFERENCE TO RELATED APPLICATION

This is a continuation of application Ser. No. 552,048, filed Feb. 24, 1975, which in turn is a continuation-in-part application of Ser. No. 418,774 filed Nov. 23, 1973 both now abandoned.

BACKGROUND OF THE INVENTION

Asphalt pavements, besides being subject to corrosion by sun and rain, as well as to deterioration and disintegration from two other sources, namely, from the chemical action of oils, greases, and other petroleum products, and from mechanical action such as is produced by contact of the wheels of vehicles and other objects in passing over surfaces of such pavements.

Heat of the sun causes softening of the asphalt surface and, in combination with the oxygen of the atmosphere, produces oxidation of the asphalt, thereby hastening its deterioration. Rain, by seeping into the asphalt surface, impregnates the porous aggregate materials therein with which the asphalt is normally mixed in producing such pavements, thereby also hastening the disintegration of the pavement.

By their chemical action, oils, greases, and other petroleum products, dissolve the asphalt, thereby loosening it from the aggregate with which it is normally mixed. This loosening is hastened by the movement of vehicles thereover and by other mechanical sources to which the pavement is normally subjected.

The size of the particles of the aggregate materials that are mixed with the asphalt in producing a pavement have a pronounced effect on the degree of resistance that the pavement provides against skidding or sliding, which resistance increases with the increase in size and porosity of the particle of the aggregate. The amount of oil, grease, and other liquids that can seep into surface of the pavement also increases with the porosity of the aggregate.

In order to reduce deterioration and disintegration of asphalt pavements from such sources, epoxy resins have been combined with asphalt by melting the two substances together. Although such a mixture reduces to a degree of about 15% the effects of such chemical and mechanical actions, the cost of the pavement is increased about 350%, and the curing of the epoxy resin that is thus combined with the asphalt requires almost 72 hours.

Attempts to improve the resistance of such asphalt pavements to corrosion by applying calcined bauxite over the asphalt surface fails to achieve any desirable results because of the failure of the calcined bauxite adequately to adhere to or combine with the asphalt.

SUMMARY OF THE INVENTION

The object of the present invention is to improve the resistance of asphalt pavements to corrosion, that is, to deterioration and disintegration by chemical and mechanical actions.

This object is achieved, in accordance with the processes and compositions of the present invention, by applying to the surface of the asphalt pavement, either by a manual or mechanical brushing or rolling operation, or by spraying, or by a combination of such operations, a liquid coating composition which consists essentially of finely divided particles of a solid substance having a hardness between 8.5 and 9.5 as measured on the Moh scale of hardness, such as a mixture of particles of silicon carbide and electrofused alumina having a maximum particle size of 104 microns, dispersed in an organic vehicle comprising a binder consisting of a plurality of synthetic organic resins dissolved in a suitable solvent or solvent medium.

The said liquid coating composition is distributed evenly over the asphalt surface that is to be protected in such amounts that the remaining film after drying has an average thickness between 150 and 700 microns, dependent upon the porosity of the surface. The film should seep into and penetrate below the surface of the asphalt, preferably, for a film having a thickness of 500 microns, to a distance of at most 250 microns, which provides a tight binding of the particles of the inorganic solids in the liquid coating composition to the surface of the asphalt. To achieve an adequate degree of penetration and adhesion of the film to the asphalt surface it may be necessary to soften the asphalt surface preliminarily by heating it to a maximum temperature of 110° C., and preferably between 80° and 90° C., if it is not already at that temperature, applying the coating composition thereto, and thereafter pressing the surface by passing a roller having a synthetic rubber roll thereover to exert a pressure between 50 to 500 grams per square centimeter over the said surface, dependent upon the porosity of the said surface. After such application of the coating composition, a period of at least 15 minutes should be allowed to elapse before the pavement is reopened to traffic, although a period of 60 minutes is normally required for the composition to become completely dry and harden or set.

DETAILED DESCRIPTION AND PREFERRED EMBODIMENTS OF THE INVENTION

Examples of liquid coating compositions which are suitable for application to asphalt pavements in accordance with the processes of the present invention as hereinbefore described and methods for their preparation follow. It is to be understood that these examples were selected solely for purposes of illustration and are consequently not to be construed as restrictive of the invention.

All parts that are specified herein are to be understood to be parts by weight, unless otherwise indicated.

COMPOSITION A

In this composition the vehicle consisted of the following resinous binders and solvents:

| | |
|---|---|
| Oil-soluble phenol-formaldehyde resin | 10 parts |
| Epoxy-modified phenolic resin | 10 parts |
| Poly(methyl methacrylate) resin | 12 parts |
| Trichloroethylene | 5 parts |
| Toluene | 15 parts |
| Butyl acetate | 15 parts |
| Ethyl acetate | 3 parts |

The oil-soluble phenol-formaldehyde resin has a melting point of 121°–135° C., an acid number of 15–20, and a USDA color of M-K.

In preparing the vehicle, the resins, which are the binders, are added to the mixture of the solvents and dissolved therein by use of a low-speed mixer while the mixture is heated in an autoclave to a temperature of 160° C. The vehicle is then mixed in a high-speed mixer with the following solid substances in the form of finely ground powders:

| | |
|---|---|
| Silicon carbide particles | 40 parts |
| Electrofused alpha-alumina particles | 15 parts |
| Colloidal alumina particles | 7 parts |

The silicon carbide particles were finer than 150 mesh Tyler sieve size, namely, a maximum size of 104 microns, and contained at least 75% of alpha and beta forms of silicon carbide.

The electrofused alpha-alumina particles were also finer than 150-mesh Tyler sieve size and contained at least 75% of alpha-alumina.

The colloidal alumina particles contained at least 75% of alumina and had a size smaller than 5 microns (270-mesh Tyler sieve).

COMPOSITION B

In this composition the vehicle consisted of the following:

| | |
|---|---|
| Solid cured (thermoset) phenol-formaldehyde resin | 15 parts |
| Oil-soluble phenol-formaldehyde resin | 10 parts |
| Urethane resin (Monothene A) | 6 parts |
| Polyethylene glycol | 8 parts |
| Trichloroethylene | 7 parts |
| Toluene | 15 parts |
| Xylene | 15 parts |

The solid cured thermoset phenol-formaldehyde resin is a phenol-formaldehyde condensation product that has been hardened with hexamethylenetetraamine, and ground to a fineness sufficient to pass through a 325-mesh sieve, that is to a maximum size of 43 microns.

In preparing this vehicle, the solid and the oil-soluble phenol-formaldehyde resin and polyethylene glycol as plasticizer were added to the toluene and xylene and the mixture was heated in an autoclave at a temperature of 180° C. with stirring for a period of 45 minutes. The urethane resin was then added and the mixture was then cooled to a temperature between 50° and 60° C.

To this vehicle was then added with stirring in a low-speed mixer the trichloroethylene and the following solids in the form of fine powders:

| | |
|---|---|
| Electrofused alpha-alumina (as hereinbefore) | 20 parts |
| Silicon carbide (as hereinbefore) | 20 parts |
| Quartz | 20 parts |
| Drying powder | 2 parts |

Thereafter, while the resulting composition was stirred with a high-speed stirrer rotating at a speed of 50 to 100 revolutions per minute, the following powder was added thereto and the stirring continued for an additional 50 minutes:

| | |
|---|---|
| Thixotropic silica gel particles | 8 parts |

The particles of the thixotropic silica gel had sizes of 53 microns or less, that is passed through a 270-mesh Tyler or United States series sieve.

COMPOSITION C

The vehicle for this composition consisted of the following substances:

| | |
|---|---|
| Polyester resin | 15 parts |
| Poly(vinyl chloride) resin | 15 parts |
| Polystyrene (crystalline) resin | 3 parts |
| Methyl isobutyl ketone | 18 parts |
| Mineral spirits (ligroin) | 15 parts |
| Boiled linseed oil | 5 parts |

In preparing the vehicle for this composition, the resins were added to a mixture containing the mineral spirits and boiled linseed oil and heated in an autoclave for 2 hours with stirring at a temperature of about 190° C., after which the mixture was cooled rapidly to a temperature of 60° C. and the methyl isobutyl ketone was added thereto while the mixture was stirred in a low-speed mixer.

The polyester resin that was used had a viscosity of 350–450 centipoises, a styrene content of 47–49% by weight, a specific gravity of 1.04–1.05, an acid number less than 12, and a pink color.

During the course of 15 minutes, while the mixture is stirred at a speed of 1800 revolutions per minute, the following finely divided solids were added thereto:

| | |
|---|---|
| Silicon carbide (as hereinbefore) | 60 parts |
| Electrofused alpha-alumina (as hereinbefore) | 30 parts |

Subsequently the following was also added thereto:

| | |
|---|---|
| Extra-fine washed kaolin | 15 parts |

and the mixture was stirred for an additional period of 90 minutes at a speed of 5200 revolutions per minute to incorporate the kaolin thoroughly therein.

Composition C is particularly adapted for application to hot asphalt pavements as they are being laid.

COMPOSITION D

The vehicle for this composition consisted of the following substances:

| | |
|---|---|
| Oil-soluble phenol-formaldehyde resin | 18 parts |
| Poly(methyl methacrylate) resin | 15 parts |
| Dibutyl phthalate | 2 parts |
| Boiled linseed oil | 7 parts |
| Cobalt siccative (drier) | 2 parts |
| Toluene | 15 parts |
| Xylene | 8 parts |
| Petroleum ether (naphtha) | 7 parts |

In preparing the vehicle for this composition, the resins, boiled linseed oil, and dibutyl phthalate plasticizer were heated together for 90 minutes at a temperature of 165° C. and then rapidly cooled during the course of 20 minutes to a temperature of 80° C. This mixture was then milled in a ball mill rotating at a speed of 45 revolutions per minute for 2½ hours with the toluene and the following finely divided solids:

| | |
|---|---|
| Silicon carbide (as hereinbefore) | 35 parts |
| Electrofused alpha-alumina | |

-continued

| | |
|---|---|
| (as hereinbefore) | 15 parts |
| Quartz | 5 parts |
| Talc | 3 parts |

Thereafter the petroleum ether and xylene were added thereto and the mixture was stirred in a high-speed mixer rotating at 5200 revolutions per minute.

Composition D has a lower viscosity than any of the preceding compositions A to C.

To produce colored films and pavements, colored pigments may be added for that purpose to any of the foregoing compositions in conventional manner.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A process for improving the resistance of the surface of an asphalt pavement to corrosion, deterioration and disintegration which consisting of the step of applying directly to the pavement a liquid composition consisting of at least one cured resin, a solvent for said resin and having dispersed therein finely divided particles of solid inorganic substances having a hardness between about 8.5 and 9.5 on the Mohs scale, said composition being applied to the pavement in a quantity sufficient to form a coating on the pavement which is firmly anchored thereto due to the impregnation of the pavement by the resin.

2. A process according to claim 1, wherein said particles of solid inorganic substances comprise a mixture of silicon carbide and electrofused alumina.

3. A process according to claim 1, wherein said particles have a maximum particle size of 104 microns.

4. A process according to claim 1, wherein said liquid composition is applied to the pavement in an amount sufficient to provide thereon a dry film having an average thickness of between 150 and 700 microns.

5. A process according to claim 4, wherein said liquid composition is applied to the pavement in an amount sufficient to provide thereon a dry film having a thickness of about 500 microns which penetrates below the pavement surface to a depth of at least 250 microns.

6. A process according to claim 1, wherein said liquid composition is applied to an asphalt pavement having a temperature between 80° and 90° C. and a pressure of between 50 and 500 grams per square centimeter is then exerted thereon by means of a synthetic rubber roll.

7. A process according to claim 1, wherein said resin is at least one member selected from the group consisting of phenol-formaldehyde resins, epoxy-modified phenol-formaldehyde resins, poly(methylmethacrylate) resins, polyester resins, poly(vinyl chloride) resins and polystyrene resins.

8. A process according to claim 1, wherein said solvent is at least one member selected from the group consisting of toluene, butyl acetate, ethyl acetate, xylene, ligroin, linseed oil and petroleum ether.

9. A process according to claim 1, wherein said liquid composition consists essentially of

| | |
|---|---|
| oil-soluble phenol-formaldehyde resin | 10 parts |
| epoxy-modified phenolic resin | 10 parts |
| poly(methyl methacrylate) resin | 12 parts |
| trichloroethylene | 5 parts |
| toluene | 15 parts |
| butyl acetate | 15 parts |
| ethyl acetate | 3 parts |
| silicon carbide particles (finer than 150 mesh) | 40 parts |
| electrofused alpha-alumina particles (finer than 150 mesh) | 15 parts |
| colloidal alumina particles (finer than 270 mesh) | 7 parts. |

10. A process according to claim 1, wherein said liquid composition consists essentially of

| | |
|---|---|
| solid cured (thermoset) phenol-formaldehyde resin | 15 parts |
| oil-soluble phenol-formaldehyde resin | 10 parts |
| urethane resin (Monothene A) | 6 parts |
| polyethylene glycol (plasticizer) | 8 parts |
| trichloroethylene | 7 parts |
| toluene | 15 parts |
| xylene | 15 parts |
| electrofused alpha-alumina (finer than 150 mesh) | 20 parts |
| silicon carbide (finer than 150 mesh) | 20 parts |
| quartz (finer than 270 mesh) | 20 parts |
| drying powder | 2 parts |
| thixotropic silica gel particles (finer than 270 mesh) | 8 parts. |

11. A process according to claim 1, wherein said liquid composition consists essentially of

| | |
|---|---|
| polyester resin | 15 parts |
| poly(vinyl chloride) resin | 15 parts |
| polystyrene (crystalline) resin | 3 parts |
| methyl isobutyl ketone | 18 parts |
| mineral spirits (ligroin) | 15 parts |
| boiled linseed oil | 5 parts |
| silicon carbide (finer than 150 mesh) | 60 parts |
| electrofused alpha-alumina (finer than 150 mesh) | 30 parts |
| extra fine washed Kaolin | 15 parts. |

12. A process according to claim 1, wherein said liquid composition consists essentially of

| | |
|---|---|
| oil-soluble phenol-formaldehyde resin | 18 parts |
| poly(methyl methacrylate) resin | 15 parts |
| dibutyl phthalate | 2 parts |
| boiled linseed oil | 7 parts |
| cobalt siccative (drier) | 2 parts |
| toluene | 15 parts |
| xylene | 8 parts |
| petroleum ether (naphtha) | 7 parts |
| silicon carbide (finer than 150 mesh) | 35 parts |
| electrofused alpha-alumina (finer than 150 mesh) | 15 parts |
| quartz (finer than 270 mesh) | 5 parts |
| talc | 3 parts. |

* * * * *